US011690403B2

(12) United States Patent
Yamada

(10) Patent No.: US 11,690,403 B2
(45) Date of Patent: Jul. 4, 2023

(54) FLAVOR GENERATING SEGMENT, AND FLAVOR GENERATING ARTICLE AND FLAVOR INHALATION SYSTEM EQUIPPED THEREWITH

(71) Applicant: JAPAN TOBACCO INC., Tokyo (JP)

(72) Inventor: Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 98 days.

(21) Appl. No.: 17/482,759

(22) Filed: Sep. 23, 2021

(65) Prior Publication Data

US 2022/0000177 A1 Jan. 6, 2022

Related U.S. Application Data

(63) Continuation of application No. 16/721,099, filed on Dec. 19, 2019, now Pat. No. 11,154,093, which is a (Continued)

(30) Foreign Application Priority Data

Jun. 22, 2017 (WO) ..... PCT/JP2017/023076

(51) Int. Cl.
*A24F 40/20* (2020.01)
*A24F 40/30* (2020.01)
(Continued)

(52) U.S. Cl.
CPC ..... *A24F 40/46* (2020.01); *A24F 40/30* (2020.01); *A24F 40/40* (2020.01); *A24F 40/20* (2020.01)

(58) Field of Classification Search
CPC ..... A24F 40/20; A24F 40/30; A24F 40/40; A24F 40/46; A24D 1/20
See application file for complete search history.

(56) References Cited

U.S. PATENT DOCUMENTS 5,327,915 A * 7/1994 Porenski ..... A24D 1/22 131/194
2015/0107610 A1* 4/2015 Metrangolo ..... A24C 5/01 131/335

(Continued)

FOREIGN PATENT DOCUMENTS

JP 2015-517817 A 6/2015
WO WO 2016/135342 A2 9/2016

(Continued)

OTHER PUBLICATIONS

Extended European Search Report for European Application No. 18819746.1, dated Mar. 12, 2021.

(Continued)

*Primary Examiner* — Hae Moon Hyeon
*Assistant Examiner* — Thang H Nguyen
(74) *Attorney, Agent, or Firm* — Birch, Stewart, Kolasch & Birch, LLP

(57) ABSTRACT

A flavor generating segment includes a first flavor generating member and a second flavor generating member, wherein: at least either of the first and the second flavor generating members includes a plurality of stacked flavor generating sheets and has, between at least a pair of the neighboring flavor generating sheets, a non-contact part in which the flavor generating sheets do not come into contact with each other; and principal surfaces of the flavor generating sheets face the other flavor generating member, as well as a flavor generating article and a flavor inhalation system equipped therewith. The flavor generating segment gives a good smoking flavor.

16 Claims, 10 Drawing Sheets

Related U.S. Application Data continuation of application No. PCT/JP2018/023896, filed on Jun. 22, 2018.

(51) Int. Cl.
*A24F 40/40* (2020.01)
*A24F 40/46* (2020.01)

(56) References Cited

U.S. PATENT DOCUMENTS

2015/0150302 A1* 6/2015 Metrangolo ..... A24C 5/18 131/230
2015/0223515 A1 8/2015 McCullough
2015/0374036 A1* 12/2015 Suzuki ..... A24F 40/46 131/329
2017/0055576 A1* 3/2017 Beeson ..... A24D 1/02
2017/0238612 A1* 8/2017 Daryani ..... A24F 40/30
2018/0027882 A1* 2/2018 Hepworth ..... A24F 40/42
2018/0343917 A1* 12/2018 Sutton ..... A24F 40/42
2019/0133188 A1* 5/2019 Spencer ..... F21V 21/14
2020/0046026 A1* 2/2020 Pijnenburg ..... H05B 3/06
2020/0093177 A1* 3/2020 Han ..... H05B 3/42
2020/0359682 A1* 11/2020 Han ..... A24F 40/57

FOREIGN PATENT DOCUMENTS

WO WO 2016/156495 A2 10/2016
WO WO 2016/156509 A1 10/2016
WO WO-2016156495 A2 * 10/2016 ..... A24B 15/167
WO WO-2016156510 A2 * 10/2016 ..... A24B 15/14

OTHER PUBLICATIONS

International Search Report for PCT/JP2018/023896 dated Aug. 28, 2018.

* cited by examiner

FLAVOR GENERATING SEGMENT, AND FLAVOR GENERATING ARTICLE AND FLAVOR INHALATION SYSTEM EQUIPPED THEREWITH

CROSS REFERENCE TO RELATED APPLICATIONS

This application is a Continuation of copending application Ser. No. 16/721,099, filed on Dec. 19, 2019, which is a Continuation of International Application No. PCT/JP2018/023896, filed on Jun. 22, 2018, which claims the benefit under 35 U.S.C. § 119(a) to Patent Application No. PCT/JP2017/023076, filed in Japan on Jun. 22, 2017, all of which are hereby expressly incorporated by reference into the present application.

TECHNICAL FIELD

The present invention relates to a flavor generating segment, and a flavor generating article and a flavor inhalation system equipped therewith.

BACKGROUND ART

As a substitute for conventional cigarettes, a non-combustion type flavor inhalation system has been under development. For example, Patent Literature (PTL) 1 discloses a tobacco cartridge comprising: a housing having a depression for placing a plate heater; and a layered structure of smokable materials inside the housing, where the layered structure is arranged on the inner surface of the housing so as to come close to the heater via the depression wall of the housing (PTL 1, FIG. 4).

CITATION LIST

Patent Literature

PTL 1: WO 2016/156495

SUMMARY OF INVENTION

Technical Problem

There is a need for a better smoking flavor obtained by such a non-combustion type flavor inhalation system. In this aspect, however, there is still room for improvements in the technique described in PTL 1. In view of this, an object of the present invention is to provide a flavor generating segment that gives a good smoking flavor, as well as a flavor generating article and a flavor inhalation system equipped therewith.

Solution to Problem

The present inventors found that the above-mentioned object can be attained by a flavor generating segment having a particular structure, thereby completing the present invention. Specifically, the above-mentioned object is attained by the following present invention.

[1] A flavor generating segment comprising a first flavor generating member and a second flavor generating member, where:

at least either of the first and the second flavor generating members includes a plurality of stacked flavor generating sheets and, between at least a pair of the neighboring flavor generating sheets, a non-contact part in which the flavor generating sheets do not come into contact with each other is included; and principal surfaces of the flavor generating sheets face the other flavor generating member.

[2] The flavor generating segment according to [1], where between at least a pair of the neighboring flavor generating sheets, one or more contact portions in which the flavor generating sheets come into contact with each other are further included.

[3] The flavor generating segment according to [2], where two or more of the contact portions are included, and the non-contact part is formed between the contact portions.

[4] The flavor generating segment according any of [1] to [3], having a space between the first flavor generating member and the second flavor generating member.

[5] The flavor generating segment according to [4], where:

the first flavor generating member and the second flavor generating member each include a heat transfer sheet; and the heat transfer sheet is exposed to the space.

[6] The flavor generating segment according to any of [1] to [5], where at least one of a plurality of the flavor generating sheets has underwent surface processing on at least either surface partially or completely.

[7] The flavor generating segment according to [6], where the surface processing is crimping.

[8] The flavor generating segment according to any of [1] to [7], further comprising a wrapper outside the flavor generating members.

[9] A flavor generating article comprising the flavor generating segment according to any of the above-mentioned [1] to [8] and a filter, where the article allows inhalation from a side of the filter.

[10] A flavor inhalation system comprising the flavor generating segment according to any of the above-mentioned [1] to [8] and a heater for heating the flavor generating segment.

[11] The flavor inhalation system according to [10], where: the flavor generating segment has a space between the first flavor generating member and the second flavor generating member; and the heater has a shape that allows at least part of the heater to be positioned within the space.

[12] The flavor inhalation system according to [11], where: the first flavor generating member and the second flavor generating member each include a heat transfer sheet exposed to the space; and the heat transfer sheet faces the heater.

[13] The flavor inhalation system according to any of [10] to [12], where the heater is a plate heater.

[14] A manufacturing method for the flavor generating segment according to any of [1] to [8], comprising:

a step A of placing the first flavor generating member and the second flavor generating member apart from each other on a substrate; and a step B of folding the substrate such that upper surfaces of the two flavor generating members face each other, thereby forming a rod segment.

[15] The manufacturing method according to [14], where the step B further includes forming a space between the two flavor generating members facing each other.

[16] The manufacturing method according to [14] or [15], where the step A further includes forming an opening on the substrate between the first flavor generating member and the second flavor generating member.

[17] A precursor for the flavor generating segment according to any of the above-mentioned [1] to [8], comprising:

a substrate; and a first flavor generating member and a second flavor generating member arranged apart from each other on the substrate, where:

at least either of the flavor generating members includes a plurality of flavor generating sheets stacked parallel to the substrate and has, between at least a pair of the neighboring flavor generating sheets, a non-contact part in which the flavor generating sheets do not come into contact with each other.

Advantageous Effects of Invention

According to the present invention, it is possible to provide a flavor generating segment that gives a good smoking flavor, as well as a flavor generating article and a flavor inhalation system equipped therewith.

DESCRIPTION OF EMBODIMENTS

In the present invention, a flavor generating segment is a base material for generating flavor. A flavor generating article is an article that includes at least the flavor generating segment and allows generation of flavor or a rod article that includes at least the flavor generating segment and allows inhalation of flavor. The flavor generating article includes the flavor generating segment, but the flavor generating segment per se may be a flavor generating article. A flavor inhalation system refers to a combination of the flavor generating article and a heating unit equipped with a heater.

1. Flavor Generating Segment

Figure 1:
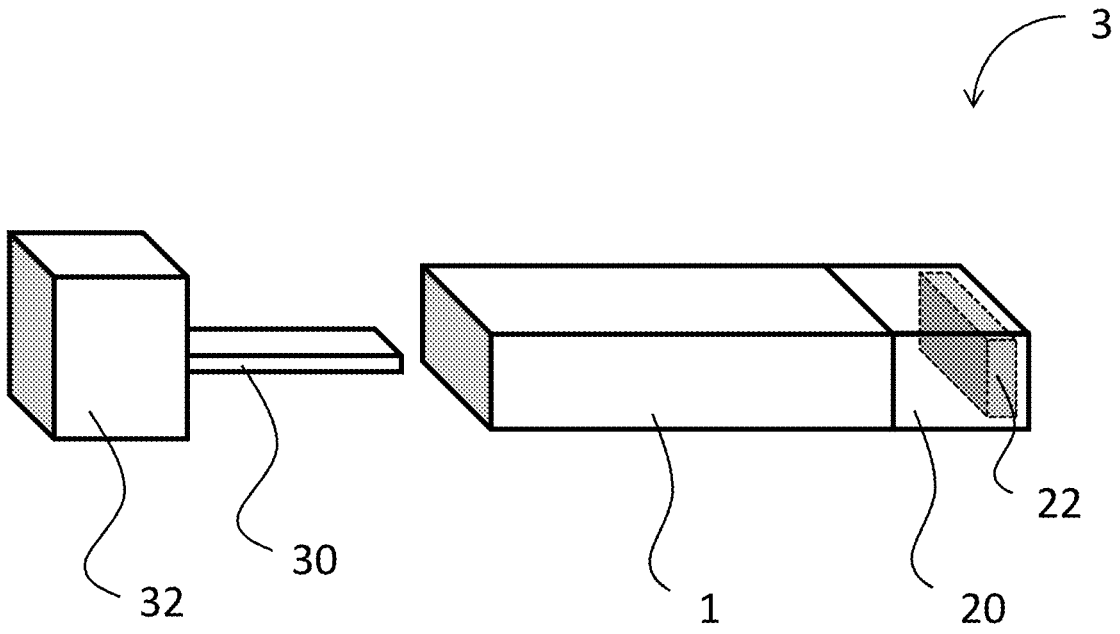
FIG. 1 is a schematic view of a flavor inhalation system of the present invention.
Figure 2A:
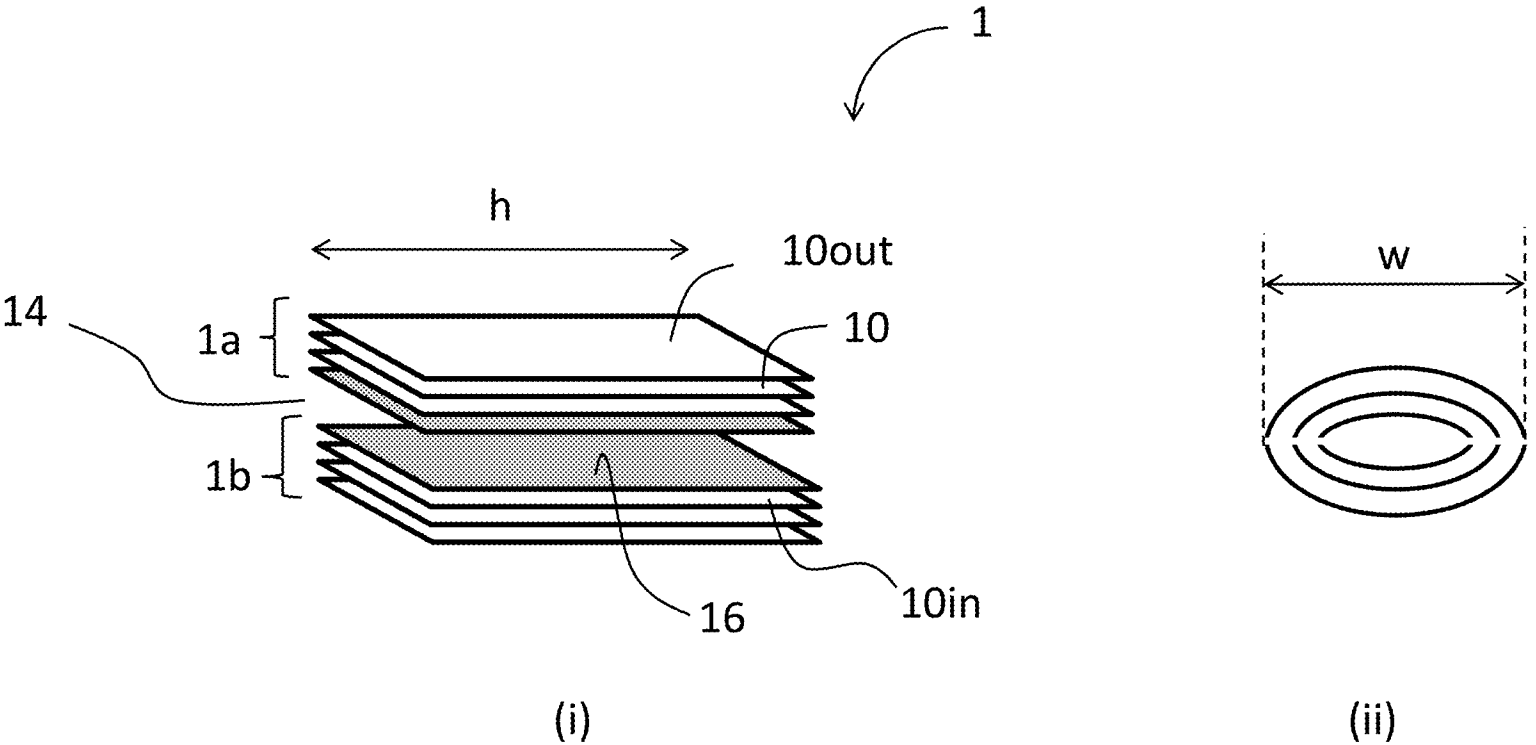
FIG. 2A schematically illustrates a flavor generating segment of the present invention.

FIG. 2A illustrates an embodiment of a flavor generating segment of the present invention. In FIG. 2A, 1*a* is a first flavor generating member, 1*b* is a second flavor generating member, 10 is a flavor generating sheet, $\mathbf{10}_{out}$ is an outermost flavor generating sheet, $\mathbf{10}_{in}$ is an innermost flavor generating sheet, 14 is a space, and 16 is a heat transfer sheet. The first flavor generating member 1*a* and the second flavor generating member 1*b* are arranged facing each other. In this configuration, principal surfaces of both the flavor generating members are preferably arranged facing each other, and the principal surfaces are more preferably arranged in parallel. In FIG. 2A, two flavor generating members are each formed from a plurality of flavor generating sheets. However, either of the flavor generating members may be formed of one flavor generating sheet or a flavor generating block. In the present invention, the term "sheet" refers to a shape having a pair of almost parallel principal surfaces and side surfaces. Such a sheet is preferably manufactured by papermaking. Meanwhile, the flavor generating block is preferably manufactured by a method other than papermaking, such as injection molding or extrusion molding. The shape of the flavor generating block is not limited, but may be a cube, a rectangular parallelepiped, a circular cylinder, an elliptic cylinder, or the like, and is preferably a rectangular parallelepiped. In such an embodiment, the two flavor generating members are arranged such that the principal surfaces of the flavor generating sheets face the flavor generating block. In view of efficiency in flavor delivery, both of the two flavor generating members are preferably formed from a plurality of flavor generating sheets. Accordingly, the present invention will be described hereinafter using such an embodiment as an example.

The shape of the flavor generating segment 1 of the present invention is not limited, but is preferably columnar. The flavor generating segment 1 of the present invention preferably has a columnar shape that satisfies an aspect ratio defined below of 1 or more.

$$\text{Aspect ratio}=h/w$$

where w is the width of the base of a column, h is the height, and $h \geq w$ is preferably satisfied. The shape of the base is not limited and may be a polygon, a rounded polygon, a circle, an ellipse, or the like. The width w is a diameter when the base is a circle; a major axis when the base is an ellipse; or a diameter of a circumscribed circle or a major axis of a circumscribed ellipse when the base is a polygon or a rounded polygon. For example, when the flavor generating sheets of the embodiment illustrated in FIG. 2A (i) is bundled with a wrapper described hereinafter to obtain a flavor generating segment having the base shape as illustrated in FIG. 2A (ii), the base is elliptic and the above-described width w of the base can be recognized as the major axis of a circumscribed ellipse. When the major axis and the length orthogonal thereto are considered, the former corresponds to the width w and the latter corresponds to the height h. In view of ease in manufacture and the like, the base is preferably a polygon and more preferably a quadrilateral. The flavor generating segment 1 preferably has a height h of about 5 to 20 mm and a width w of about 2 to 5 mm. Although not shown, the flavor generating segment 1 may include a wrapper in the outermost part. The wrapper may be a rolling paper or may be formed from the flavor generating sheet 10. Further, the wrapper may be formed from a substrate 6 as described hereinafter.

The flavor generating sheet is a sheet that generates flavor, and examples include a sheet formed by supporting a component that allows generation of flavor on a sheet substrate or a sheet formed from a material that generates flavor. A plurality of flavor generating sheets are stacked to form a flavor generating member. The term "stacking" herein means arranging flavor generating sheets so as to place one principal surface over another. It is noted that at least a pair of the neighboring flavor generating sheets have a non-contact part. Accordingly, "stacking" in the present invention excludes an embodiment in which all the neighboring pairs of flavor generating sheets come into contact with each other on the whole surfaces. In other words, when a flavor generating member includes three or more flavor generating sheets, a pair of the sheets may come into contact with each other on the whole surfaces if another pair of the sheets have a non-contact part. However, in view of efficiency in flavor delivery and the like, non-contact parts are preferably included between all the sheets in the present invention.

Examples of the component that allows generation of flavor include: smoking flavor components contained in tobacco raw materials; and flavoring components, such as menthol. Examples of the sheet substrate include compressed tobacco pellets and tobacco materials, such as tobacco powder. In the present invention, the sheet substrate is preferably a tobacco material. Specifically, a flavor generating sheet is preferably a tobacco sheet formed by supporting, as necessary, a component that allows generation of flavor on a substrate sheet of a tobacco material. The flavor generating sheet may generate an aerosol upon heating. To promote generation of an aerosol, an aerosol source, such as glycerol, propylene glycol, 1,3-butanediol, or other polyols, may be further added. The amount of the aerosol source to be added is preferably 5 to 50% by weight and more preferably 10 to 30% by weight relative to the dry weight of a flavor generating sheet. Here, polyols, such as glycerol, propylene glycol, and 1,3-butanediol, may also be added as smoking flavor components. When an aerosol source is contained or when a flavoring component generates an aerosol, a flavor generating sheet is deemed an aerosol generating sheet as well.

First, a flavor generating sheet as a material before stacking will be described.

1) Preparation

When a flavor generating sheet is an aerosol generating sheet and preferably a tobacco sheet, such a tobacco sheet may be appropriately manufactured by a publicly known method, such as papermaking, slurry, or rolling method. Specifically, in the case of papermaking, a tobacco sheet can be manufactured by a method including the following steps. 1) A dry leaf tobacco raw material is coarsely crashed and extracted with water to separate into a water extract and a residue. 2) The water extract is condensed by drying under reduced pressure. 3) The residue is added with pulp, formed into fibers in a refiner, and made into paper. 4) A sheet of the resulting paper is added with the condensate of the water extract and dried into a tobacco sheet. In this case, a step of removing part of the components, such as nitrosamines, may be added (see Japanese Unexamined Patent Application Publication (translation of PCT Application) No. 2004-510422). In the case of a slurry method, a tobacco sheet can be manufactured by a method including the following steps. 1) Water, pulp, a binder, and crashed tobacco are mixed. 2) The resulting mixture is thinly spread (cast) and dried. Further, it is also possible to use a nonwoven fabric-like tobacco sheet manufactured by a method including the following steps as described in WO 2014/104078. 1) A powdery, granular tobacco raw material and a binder are mixed. 2) The resulting mixture is sandwiched between nonwoven fabrics. 3) The resulting stacked article is formed into a certain shape by heat fusing to yield a nonwoven fabric-like tobacco sheet. The composition of a tobacco sheet is not particularly limited, but the content of a tobacco raw material is preferably 50 to 95% by weight relative to the total weight of the tobacco sheet, for example. Moreover, the tobacco sheet may contain a binder, and examples of the binder include guar gum, xanthan gum, CMC (carboxymethyl cellulose), and CMC-Na (sodium carboxymethyl cellulose). The amount of the binder is preferably 2 to 20% by weight relative to the total weight of the tobacco sheet. The tobacco sheet may further contain other additives. Examples of such additives include filler, such as pulp. As in the foregoing, the tobacco sheet contains a component that allows generation of flavor. In the present invention, a plurality of tobacco sheets are used. All of such tobacco sheets may have the same composition or physical properties, or part of or all of such tobacco sheets may have different compositions or physical properties. When a flavor generating sheet is other than a tobacco sheet, a sheet using plant pulp other than tobacco raw materials as a sheet substrate may be employed, for example.

2) Size and the Like

The shape of a flavor generating sheet is not limited, but the shape of the sheet principal surface is preferably a quadrilateral. The thickness is not limited, but is preferably 200 μm to 2 mm and more preferably 200 to 600 μm in view of highly efficient heat exchange, the strength of a flavor generating segment, and the like. Each flavor generating sheet may have the same thickness or a different thickness. When formed into the flavor generating segment 1, the length parallel to the height h direction is referred to as the length L of a flavor generating sheet, and the length orthogonal thereto is referred to as the width W. The height h and the length L of the flavor generating sheet may be the same or different. For example, when a flavor generating segment includes a wrapper with a length of h, the height of the flavor generating segment is h. The length L of the flavor generating sheet to be sheathed with the wrapper may be shorter than h. L is preferably the same in all flavor generating sheets. When flavor generating sheets are stacked as in FIG. 2A, W is preferably the same in all the flavor generating sheets. When flavor generating sheets are bent at both long side ends and stacked or when flavor generating sheets are curved and stacked, W of the flavor generating sheet that forms the outermost layer is preferably larger than W of the flavor generating sheet that forms the innermost layer. In the embodiment illustrated in FIG. 2C, the ends of the facing flavor generating sheets may come into contact with each other.

3) Surface Processing

At least one of a plurality of the flavor generating sheets has preferably underwent surface processing on at least either surface partially or completely. Surface processing in the present invention refers to processing of forming a plurality of depressions and protrusions on at least either principal surface, in other words, either of the front surface or the rear surface of a flavor generating sheet. The method for surface processing is not particularly limited, and publicly known processing, such as crimping, embossing, debossing, and half-cutting, may be employed. In the present invention, crimping is processing of forming creases on a sheet. For example, crimping can be performed by passing through a flavor generating sheet between a pair of rollers having a plurality of protrusions on the surfaces, thereby forming, on both the front and rear surfaces of a flavor generating sheet, creases that extend orthogonal to the sheet conveying direction. Protrusions provided on such rollers extend orthogonal to the sheet conveying direction. The pitch between the apexes of the protrusions provided on the rollers is preferably 0.5 to 2.0 mm. Accordingly, the pitch of the flavor generating sheet is preferably 0.5 to 2.0 mm. Moreover, the pitch of the flavor generating sheet is preferably 1.5 to 20% relative to the width of the flavor generating segment. The height H of the depressions/protrusions formed by crimping is preferably 1.05 $T_{av}$ to 1.59 $T_{av}$ when an average thickness of the sheet is set to $T_{av}$. The height H is defined as a distance from the sheet bottom to the sheet apex when a crimped sheet is placed on a horizontal surface. Herein, embossing and debossing are processing of forming depressions on either surface or both surfaces of a sheet by pressing a protruded processing tool against the sheet. Half-cutting herein is a processing of forming, on either surface or both surfaces of a sheet, cuts with a depth at which the sheet is not cut completely and preferably cuts with a depth equal to or less than the half of the sheet thickness. A knife or a laser may be used for half-cutting. As described hereinafter, flavor generating sheets, by undergoing surface processing, can efficiently form non-contact parts or preferably voids described hereinafter when formed into a flavor generating member. All the pitches between the apexes of protrusions in the same flavor generating sheet may be the same or different. Moreover, pitches between the apexes of protrusions in the respective flavor generating sheets may be different for every sheet or the same.

Next, stacked flavor generating sheets will be described.

1) Plurality of Stacked Flavor Generating Sheets

At least either of the flavor generating members is formed by stacking a plurality of flavor generating sheets 10. The number of the stacked flavor generating sheets 10 is preferably 2 to 15. By setting the number of the flavor generating sheets to such a number, it is possible to generate the sufficient amount of a flavoring component while ensuring sufficient space as voids described hereinafter, thereby enhancing delivery efficiency of generated flavor. The total weight of the flavor generating members 1*a* and 1*b* contained in the flavor generating segment is preferably 130 mg to 685 mg and preferably 200 mg to 350 mg. The weight of each flavor generating sheet 10 is appropriately selected to achieve such a total weight.

Figure 10:
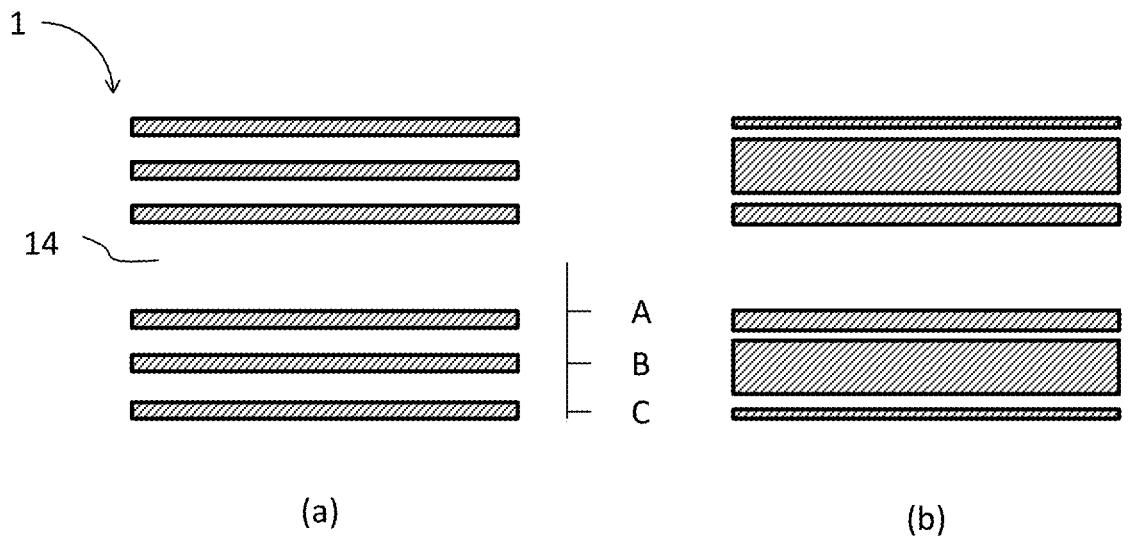
FIG. 10 illustrates an embodiment of the arrangement of the flavor generating sheets.

As in the foregoing, a flavor generating sheet contains an aerosol source, such as glycerol. Here, the weight of an aerosol source contained in each flavor generating sheet is preferably adjusted such that an aerosol is delivered uniformly from the start to the end of inhalation. For example, a case in which A to C positions are specified from the center to the outer side of a flavor generating segment as illustrated in FIG. 10 (*a*) and sheets having the same thickness exist in each region including the above-mentioned positions will be considered. In this case, when the weight of an aerosol source is the same in each sheet, the weight of the aerosol source per sheet thickness is also the same. Accordingly, it possible to make the amount of the aerosol source that can be generated at positions A, B, and C almost the same.

Meanwhile, when sheets having different thicknesses exist in regions including these positions (FIG. 10 (*b*)), the amounts of the aerosol source to be generated at positions A, B, and C are different since the weights of the aerosol source per sheet thickness are different even if the weight of the aerosol source is the same in each sheet. In this case, it is possible to make the amounts of the aerosol source to be generated at positions A, B, and C almost the same by designing sheets to satisfy the following relationship.

$$X/a=Y/b=Z/c$$

a: thickness of sheet A that covers position A

X: weight of an aerosol source contained in sheet A that covers position A b: thickness of sheet B that covers position B Y: weight of an aerosol source contained in sheet B that covers position B c: thickness of sheet C that covers position C Z: weight of an aerosol source contained in sheet C that covers position C Such designing is also possible, for example, by varying surface processing on the inner and outer surfaces of a sheet. Specifically, an embodiment of forming many half cuts on the inner surface and few half cuts on the outer surface is possible, for example.

Moreover, it is also possible to change a smoking flavor at a desirable timing during inhalation by varying the weights of a smoking flavor component and a flavoring component contained in a sheet arranged on the inner side and a sheet arranged on the outer side.

The flavor generating sheets are each stacked to have a non-contact part between the neighboring sheets and thus have, between at least a pair of the neighboring flavor generating sheets, a non-contact part in which the flavor generating sheets do not come into contact with each other.

2) Non-Contact Part

Between a pair of the neighboring flavor generating sheets, two or more contact portions in which the sheets come into contact with each other are preferably included. A non-contact part formed between these contact portions is referred to as a "void". Part of or all of the voids preferably extend from the leading end to the back end of the flavor generating segment. By this configuration, it is possible to ensure a flow path of flavor and enhance efficiency in flavor delivery. In addition, heat transfer efficiency can be enhanced since heat from a heater can be transferred to a flavor generating sheet on the outer side via the contact portions.

Figure 2B:
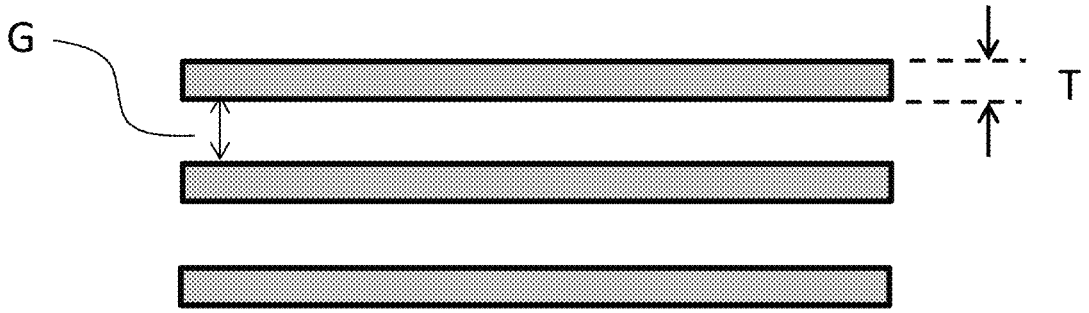
FIG. 2B schematically illustrates a part of the flavor generating segment of the present invention.

A method of forming the above-mentioned voids between a pair of neighboring flavor generating sheets is not particularly limited and may be carried out, for example, by performing the foregoing surface processing on at least one flavor generating sheet. Specifically, voids can be formed, for example, by combining flavor generating sheets in which depressions and protrusions have been formed by surface processing with flat flavor generating sheets (FIG. 2D (i)); or by avoiding placing, at the same positions, protrusions of flavor generating sheets in which depressions and protrusions have been formed by surface processing, in other words, by shifting the phase of depressions and protrusions (FIG. 2D (ii)). In FIG. 2D, C is a contact portion and V is a void. A method of shifting the phase is not limited, and exemplary methods include a method of varying the pitch in surface processing for every flavor generating sheet. The contact portions may be bonded or not. When a flavor generating sheet has a plurality of protrusions formed by surface treatment, only at least one of the protrusions needs to come into contact with the neighboring flavor generating sheet. The longitudinal direction of protrusions formed on a crimped sheet is preferably parallel or almost parallel to the longitudinal direction of the flavor generating segment. The longitudinal direction of the protrusions is a direction in which the ridge lines extend and a direction orthogonal to the sheet conveying direction during processing with a crimping roller.

The maximum interlayer distance $G_{max}$ of two neighboring flavor generating sheets is preferably larger than the maximum thickness $T_{max}$ of at least either of the two neighboring flavor generating sheets. This can be confirmed by the following method. In a cross-section of the flavor generating segment 1 as illustrated in FIG. 2B, an interlayer distance n formed between an n-th sheet and an (n+1)th sheet is measured to determine the maximum value $G_{(n)max}$. Subsequently, the thicknesses of the n-th sheet and the (n+1)th sheet are measured to determine the maximum values $T_{(n)max}$ and $T_{(n+1)max}$, followed by comparison. This measurement is performed for all the interlayer gaps. For example, when the number of sheets is four, the measurement is performed for three interlayer gaps. Subsequently, the following relationships are confirmed to be satisfied in the cross-section.

$$G_{(1)max}>T_{(1)max} \text{ or } G_{(1)max}>T_{(2)max}$$

$$G_{(2)max}>T_{(2)max} \text{ or } G_{(2)max}>T_{(3)max}$$

$$G_{(3)max}>T_{(3)max} \text{ or } G_{(3)max}>T_{(4)max}$$

When these relationships are satisfied on any cross-section, it is concluded that the maximum interlayer distance $G_{max}$ between two neighboring flavor generating sheets is larger than the maximum thickness $T_{max}$ of at least either of the two neighboring flavor generating sheets. When the measurement is difficult since flavor generating sheets 10 are not fixed, the measurement is preferably performed as follows. First, a measurement sample is prepared by impregnating the flavor generating segment 1 with a low-viscosity curable resin (epoxy resin, for example) to fill non-contact parts with the resin, followed by curing of the resin. Next, the above-described measurement is performed while cutting the prepared sample.

A ratio of the total volume of non-contact parts (hereinafter, also referred to as "void ratio") in the flavor generating segment is preferably 0.10 to 0.40, more preferably 0.15 to 0.36, and particularly preferably 0.25 to 0.33. By controlling the void ratio within the preferable range, flavor can be supplied efficiently. Further, by controlling the void ratio within the more preferable range, it is possible to maintain efficient emission of a smoking flavor component contained in sheets of the flavor generating segment from the beginning to the end of inhalation.

3) Heat Transfer Sheet

The flavor generating members 1*a* and 1*b* may each include a heat transfer sheet 16. The position of the heat transfer sheet 16 is not limited but is preferably exposed to the space 14 as illustrated in FIG. 2A in an embodiment. For example, metal sheets, such as aluminum, may be used as a heat transfer sheet.

4) Space

The flavor generating segment 1 may have the space 14 between the flavor generating members 1*a* and 1*b* as illustrated in FIG. 2A. The flavor generating segment 1 is preferably arranged such that a direction perpendicular to the stacking direction is parallel to the longitudinal direction of the flavor generating article 2, in other words, the height h is parallel to the longitudinal direction of the flavor generating article 2. Accordingly, the space 14 also preferably extends in the longitudinal direction of the flavor generating article 2. The cross-sectional area of the space is preferably 5 to 46% and more preferably 15 to 46% of the cross-sectional area of the flavor generating segment 1. The center of the space 14 may be or may not be on an axis passing through the cross-sectional center of the flavor generating segment 1, in other words, the central axis. For example, when the thickness of the flavor generating segment 1 in the stacking direction is 2R, the center O' of the space 14 may be displaced from the center O of the flavor generating segment 1 in the stacking direction by about 0.1 R to 0.7 R. The position of the center O' of the space 14 can also be displaced from the center O of the flavor generating segment 1 by adjusting the thicknesses of the flavor generating members 1*a* and 1*b*.

In the foregoing, a case in which two flavor generating members are formed from a plurality of flavor generating sheets is described. However, as described above, either of the flavor generating members needs not be formed from a plurality of flavor generating sheets. In this case, the flavor generating member may be formed of one flavor generating sheet 10 or a flavor generating block thicker than a flavor generating sheet. The thickness of the flavor generating block is not limited and may be about 2 to 10 times the thickness of a flavor generating sheet. The flavor generating block can be prepared, for example, by forming a composition containing a tobacco material and a binder into a desirable shape. Exemplary shapes include a circular cylinder and an elliptic cylinder as in the foregoing. Exemplary forming methods include methods other than papermaking, such as extrusion molding, injection molding, foam molding of a slurry, and fabrication by a 3D printer. The flavor generating block may have an open cell structure that allows air permeation in the longitudinal direction.

2. Flavor Generating Article

Figure 3:
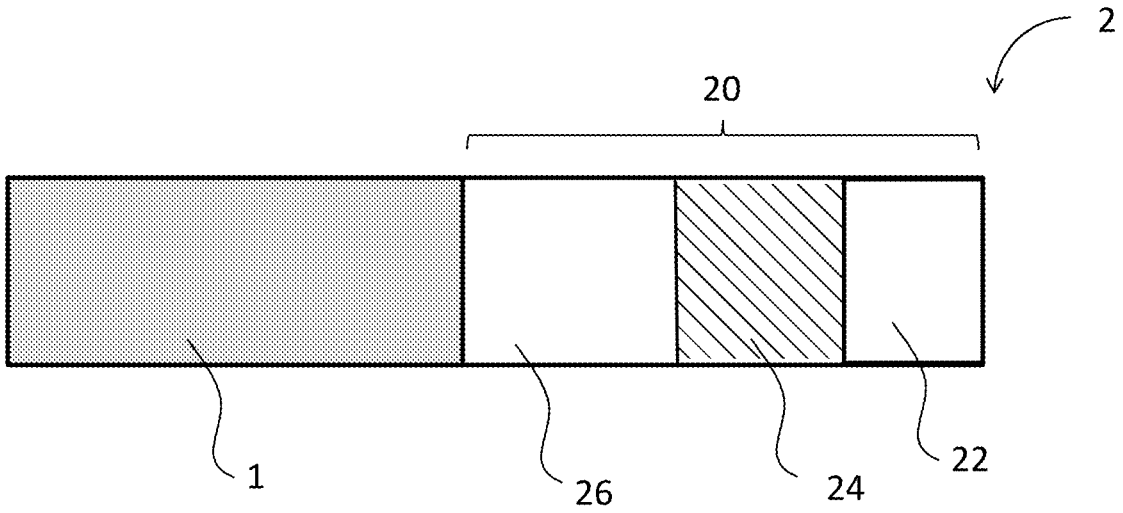
FIG. 3 schematically illustrates a flavor generating article of the present invention.

FIG. 3 illustrates an embodiment of a flavor generating article. In FIG. 3, 2 is a flavor generating article, 1 is a flavor generating segment, 20 is a mouthpiece, 22 is a filter, 24 is a cavity, and 26 is a support member. As described above, a support member or a cavity may be optionally provided in the flavor generating article. The mouthpiece 20 is a member having a mouthpiece portion and may include the filter 22. The size of the mouthpiece 20 is not limited but preferably has the same width as the flavor generating segment 1 and a length of 26 to 50 mm. In the present invention, a direction toward the mouthpiece portion is referred to as the downstream direction in some cases.

The filter 22 is preferably formed of a material commonly used in the relevant field, such as a cellulose acetate filter. The length of the filter 22 is preferably 12 to 60% of the entire length of the mouthpiece 20.

The cavity 24 is a space, and a wrapper side surface that forms the cavity 24 may be provided with a ventilation means. The cavity 24 acts, for example, to cool a heated flavor and to prepare a smoking flavor by appropriately mixing flavor with air. The length of the cavity 24 is preferably 8 to 77% of the entire length of the mouthpiece 20. Moreover, the cavity 24 may be replaced with a cooling element. Exemplary cooling elements include a polylactic acid sheet, and a plurality of polylactic acid sheets after undergoing crimping can be used as a cooling element.

Figure 7:
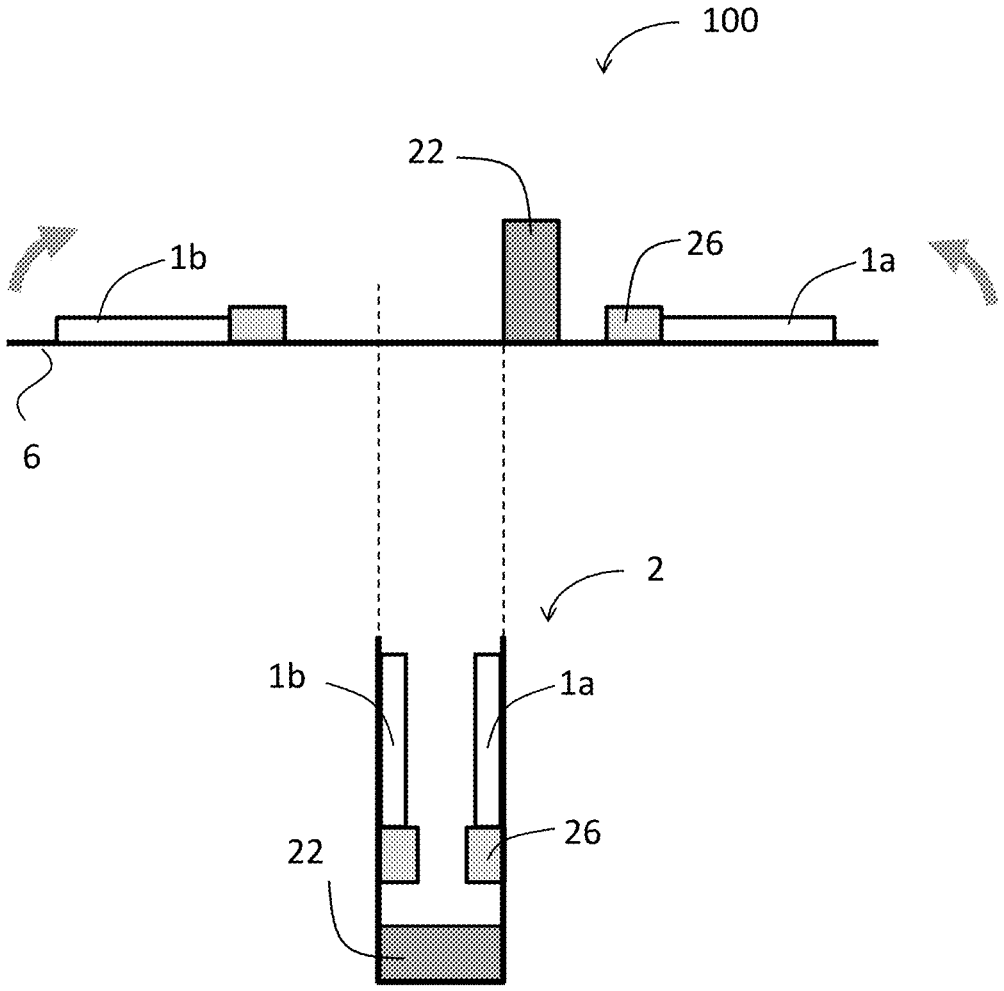
FIG. 7 schematically illustrates a manufacturing method for the flavor generating article of the present invention.

The support member 26 enhances the strength and retains the shape of the flavor generating article. The support member 26 is preferably formed from materials commonly used in the relevant field, such as cellulose acetate, polyether ether ketones (PEEK), and other heat-resistant plastics; silicon; and ceramics. For example, two support members may be arranged such that the principal surfaces face each other as illustrated in FIG. 7. The length of the support member 26 is preferably 14 to 77% of the entire length of the mouthpiece 20.

3. Flavor Inhalation System

A flavor inhalation system of the present invention includes a heater. The heater heats the flavor generating segment preferably in a non-combustion mode and more preferably electrically. The heater preferably includes a heating unit equipped with a power supply and so forth. FIG. 1 illustrates an embodiment of a flavor inhalation system of the present invention. In the figure, 1 is a flavor generating segment, 20 is a mouthpiece, 22 is a filter, 30 is a heater, and 32 is a heating unit.

The shape of the heater 30 is not limited, but part of the heater 30 preferably has a shape that allows arrangement in the space 14 of the flavor generating segment. Examples include a sheet heater, a plate heater, and a cylindrical heater. The sheet heater is a flexible sheet-shape heater, and examples include a heater containing a film (thickness of about 20 to 225 μm) of a heat-resistant polymer, such as a polyimide. The plate heater is a rigid plate-shape heater (thickness of about 200 to 500 μm), and examples include a heater having a resistance circuit as a heat generator on a plate substrate. The cylindrical heater is a hollow or solid cylindrical heater, and examples include a heater having a resistance circuit as a heat generator on the outer surface. The cross-sectional shape of the cylindrical heater may be circular, elliptic, polygonal, rounded polygonal, or the like.

Figure 4:
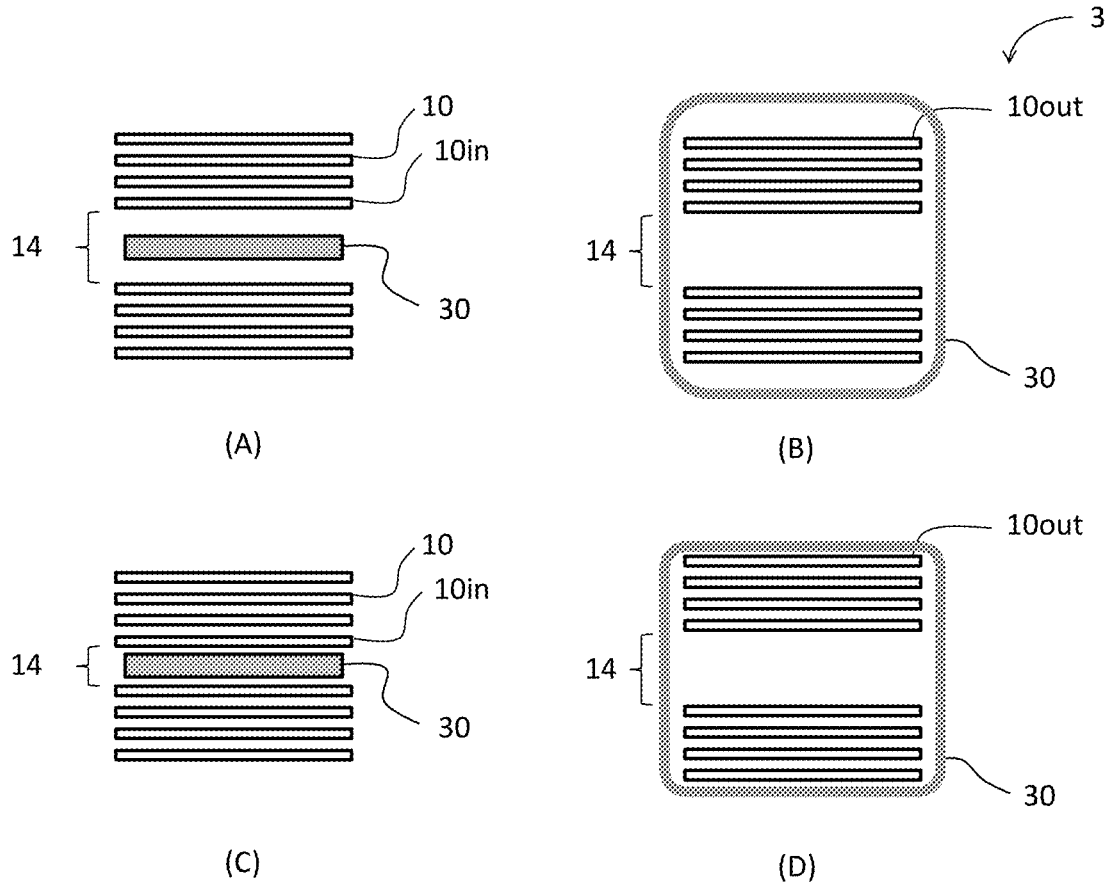
FIG. 4 illustrates the arrangement of a heater.

The heater may be arranged optionally, and preferable embodiments will be described hereinafter by means of FIG. 4. FIG. 4 illustrates a cross-section viewed from the longitudinal direction end of the flavor inhalation system of the present invention. In FIG. 4, 30 is a heater, and 10 is a flavor generating sheet.

As illustrated in FIGS. 4 (A) and (C), the heater 30 may be arranged in the space 14. FIG. 4 (A) illustrates an embodiment in which the plate heater 30 is arranged in the space. Although not shown, the flavor generating segment 1 preferably includes a heat transfer sheet stacked together with the flavor generating sheets 10, and the heat transfer sheet more preferably faces the heater 30. Accordingly, a plate heater is suitable for a case in which the flavor generating sheets 10 are heated from the inner side.

As illustrated in FIGS. 4 (B) and (D), the heater 30 may be arranged outside the outermost flavor generating sheet $\mathbf{10}_{out}$. When the flavor generating segment 1 includes a wrapper, the heater 30 may be arranged outside the wrapper. Accordingly, a sheet heater is suitable for a case in which the flavor generating sheets 10 are heated from the outer side or from the middle. In this embodiment as well, the flavor generating segment 1 preferably includes a heat transfer sheet stacked together with the flavor generating sheets 10, and the heat transfer sheet more preferably adjoins the heater 30.

4. Manufacturing Method

As described at the beginning, the flavor generating segment 1 per se may be the flavor generating article 2. Here, however, an article including the flavor generating segment 1, a filter, and so forth will be described as the flavor generating article 2.

(1) Manufacturing Method for Flavor Generating Segment

A manufacturing method for the flavor generating segment 1 of the present invention is not limited, but the flavor generating segment 1 is preferably manufactured through the following steps.

Step A: a step of placing the first flavor generating member and the second flavor generating member apart from each other on a substrate Step B: a step of folding the substrate such that upper surfaces of the two flavor generating members face each other, thereby forming the flavor generating segment 1

Figure 5:
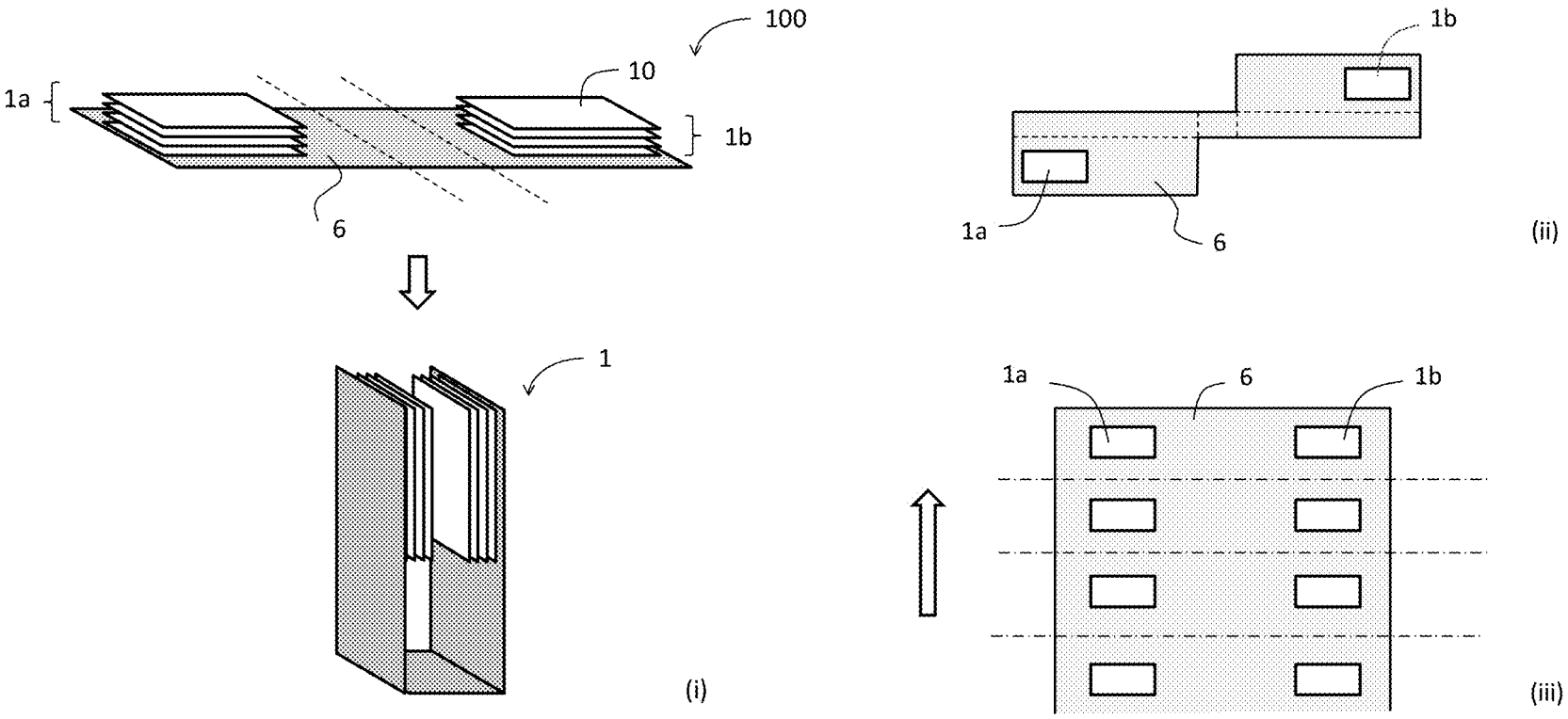
FIG. 5 schematically illustrates a manufacturing method for the flavor generating segment of the present invention.

This method will be described with reference to FIG. 5. In FIG. 5, 100 is a flavor generating segment precursor, 1*a* is a first flavor generating member, 1*b* is a second flavor generating member, and 6 is a substrate. In FIG. 5 (i), both the first flavor generating member 1*a* and the second flavor generating member 1*b* include a plurality of flavor generating sheets 10 stacked parallel to the substrate and have voids between the neighboring flavor generating sheets 10. However, at least either of the flavor generating members may include a plurality of stacked flavor generating sheets 10 and have voids between the neighboring flavor generating sheets 10. The first flavor generating member 1*a* and the second flavor generating member 1*b* are placed apart from each other. Placing apart from each other here means placing such that the upper surfaces of the flavor generating members face each other in step B. A plurality of the stacked flavor generating sheets 10 may also partially come into contact with each other such that voids are formed between the sheets.

Figure 6:
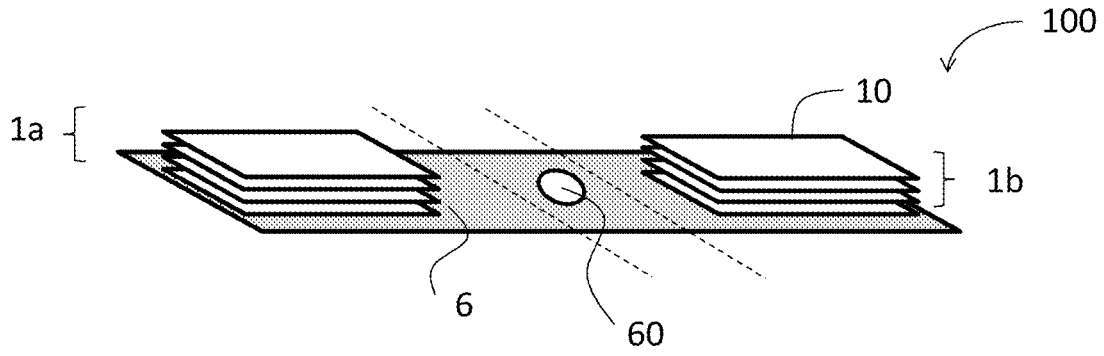
FIG. 6 schematically illustrates the manufacturing method for the flavor generating segment of the present invention.

Subsequently, the stacked structure 100 is bent at the dotted lines such that the upper surfaces of the two flavor generating members face each other, thereby forming a rod flavor generating segment 1. The flavor generating segment 1 preferably has a space 14 between the facing first flavor generating member 1*a* and the second flavor generating member 1*b*. The size of the space 14 can be adjusted, for example, by the thickness of the flavor generating members. An opening may be formed on the bottom surface of the thus-obtained flavor generating segment 1. Moreover, the flavor generating segment 1 may be formed by using a stacked structure 100 provided with an opening 60 in advance in the separating portion as illustrated in FIG. 6. The above-described manufacturing method may further includes a step of covering the flavor generating segment 1 with a wrapper.

Figure 2C:
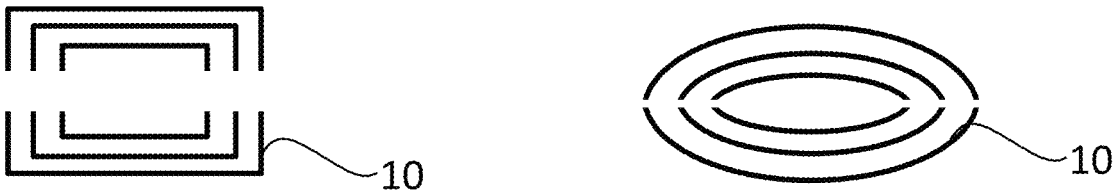
FIG. 2C illustrates an embodiment of stacked flavor generating sheets.
Figure 2D:
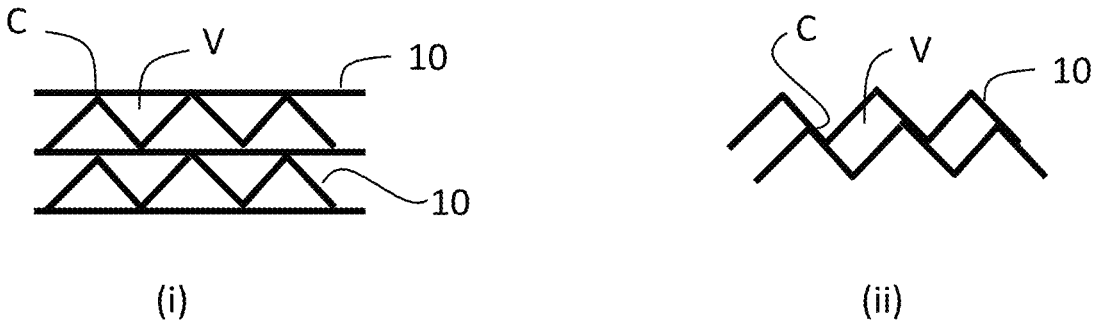
FIG. 2D illustrates voids formed in the stacked flavor generating sheets.

When the flavor generating sheets 10 are stacked in a curved manner as illustrated in FIG. 2C, each flavor generating sheet 10 may be curved in advance, followed by stacking; or flat flavor generating sheets 10 may be stacked, followed by curving.

The number of times of folding in step B may be appropriately set depending on embodiments of the arrangement of the first flavor generating member 1*a* and the second flavor generating member 1*b*. For example, the first flavor generating member 1*a* and the second flavor generating member 1*b* may be arranged on the substrate 6 such that the respective central lines are not aligned on the same line as illustrated in FIG. 5 (ii). FIG. 5 (ii) is a view from the top of the flavor generating segment precursor 100. In this case, the flavor generating segment 1 can be manufactured by folding the four dashed lines.

Further, a plurality of first flavor generating members 1*a* and second flavor generating members 1*b* may be arranged on the substrate 6 as illustrated in FIG. 5 (iii). In this case, placing apart from each other in step A means placing the first flavor generating members 1*a* and the second flavor generating members 1*b* apart from each other in a direction orthogonal to the conveying direction of the substrate 6 (shown by the arrow in the figure). In this embodiment, each flavor generating segment 1 can be manufactured by cutting at the dashed-dotted lines, followed by folding as illustrated in FIG. 5 (i).

The substrate 6 may be formed from any material, but such a material preferably exhibits flexibility that allows bending as well as barrier properties that prevent permeation, on the outer surface, of a component that allows generation of flavor. As a preferable material, rolling paper for cigarettes or tipping paper for cigarette filters that satisfies the above-mentioned characteristics can be used.

(2) Manufacturing Method for Flavor Generating Article

A flavor generating article 2 can be manufactured by inserting a filter and so forth into the bottom portion of the flavor generating segment 1 manufactured as in the foregoing. Alternatively, the flavor generating article 2 may be manufactured as illustrated in FIG. 7. FIG. 7 illustrates a stacked structure viewed from the side. Specifically, a stacked structure 100 is prepared by placing a filter member 22 and cooling members 26 in the separating portion, and the substrate is folded such that the upper surfaces of the two flavor generating members face each other.

Figure 8A:
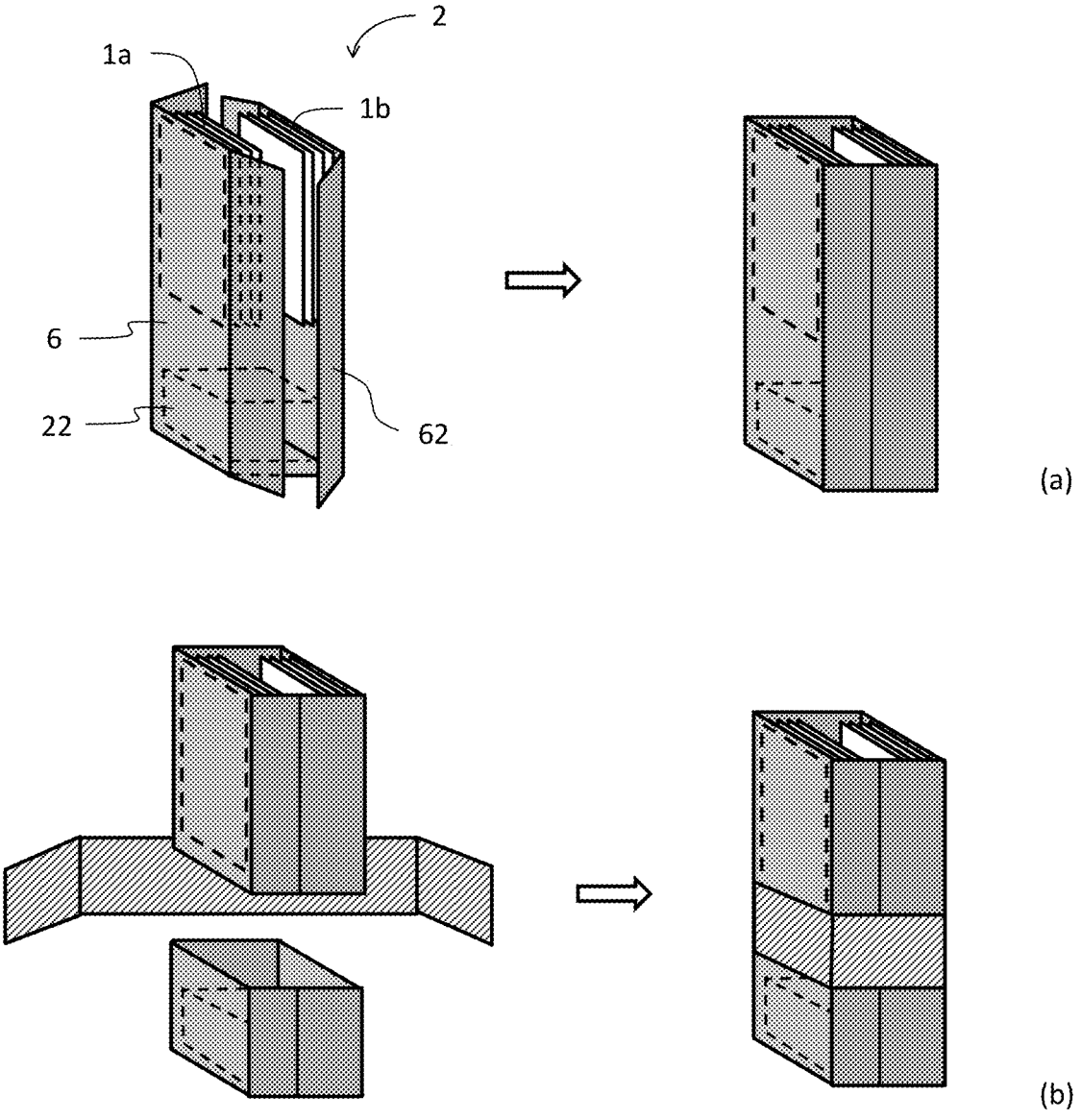
FIG. 8A schematically illustrates the manufacturing method for the flavor generating article of the present invention.

A step of covering the flavor generating article 2 with a wrapper may be further included. Alternatively, a wrapper can be formed with the substrate 6 by leaving sufficient margin 62 in the width direction of the substrate 6, folding the substrate, and then forming side walls by bending the margin 62 (FIG. 8 A (a)). In this embodiment, the substrate 6 can be regarded as a wrapper, but another wrapper (outermost member) may be further provided outside such a wrapper. Moreover, a flavor generating segment covered with a wrapper and a filter covered with a wrapper may be separately prepared and connected by a publicly known method (FIG. 8A (b)). For example, the flavor generating segment and the filter can be connected by covering the joint with cigarette tipping paper or the like to prevent leakage.

Figure 8B:
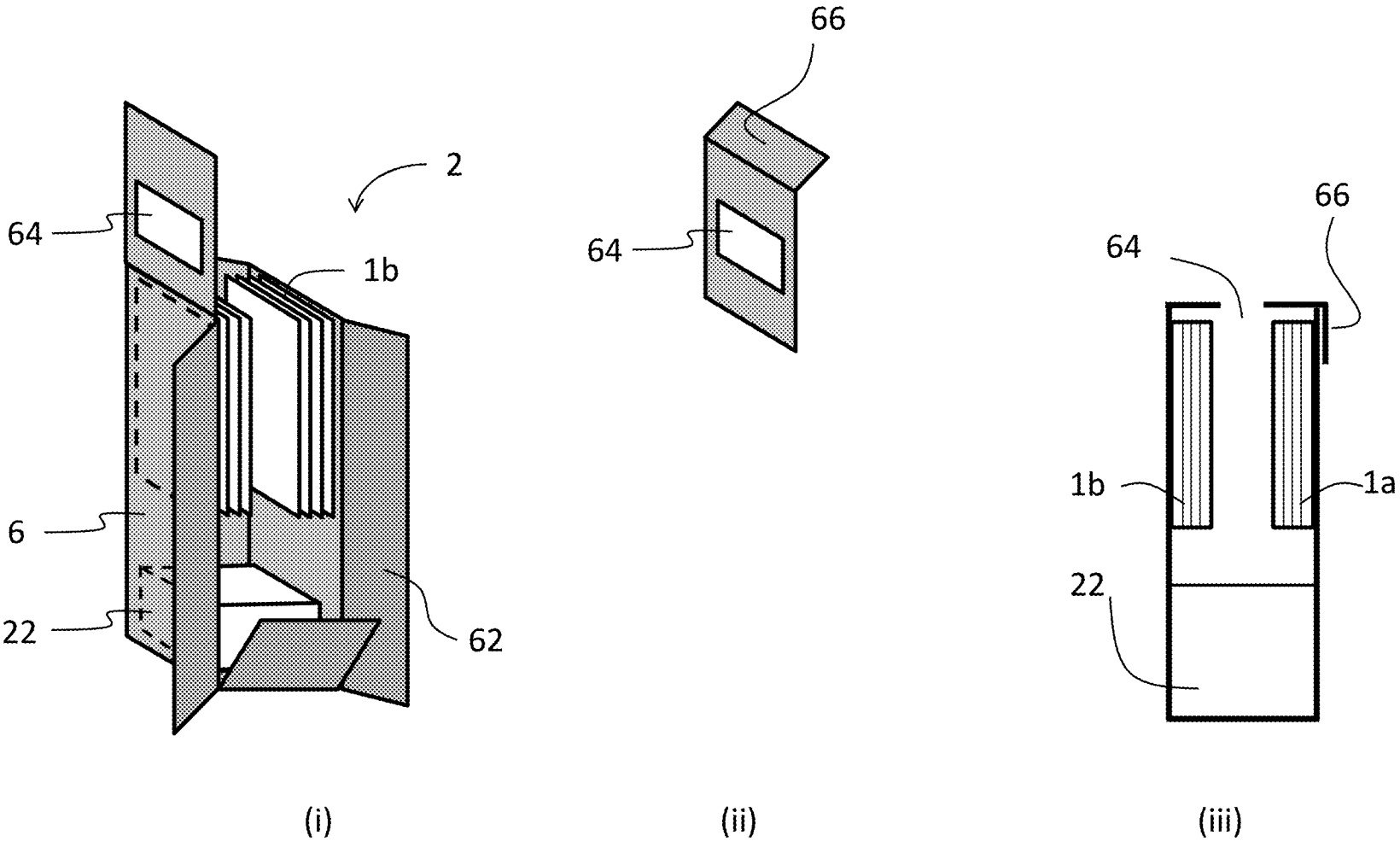
FIG. 8B schematically illustrates the manufacturing method for the flavor generating article of the present invention.

Further, a heater insertion opening 64 may be formed by forming an opening in the margin 62 as illustrated in FIG. 8B (i). Still further, a bent portion 66 may be formed in the margin 62 as illustrated in FIG. 8B (ii). By bonding the bent portion 66 with the side wall of the flavor generating article 2 as illustrated in FIG. 8B (iii), the strength of the flavor generating article 2 can be enhanced.

(3) Manufacturing Method for Flavor Inhalation System 3

Figure 9:
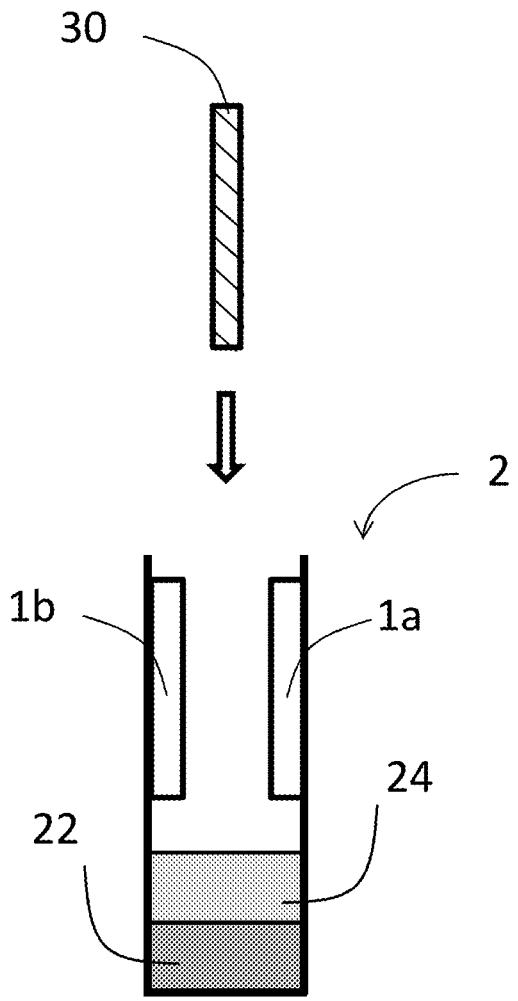
FIG. 9 schematically illustrates a manufacturing method for the flavor inhalation system of the present invention.

A flavor inhalation system 3 can be manufactured by providing a heater 30 in the flavor generating segment 1 or the flavor generating article 2, which is manufactured as in the foregoing. A method of providing the heater 30 is not limited but is preferably by inserting the heater 30 into the space 14 of the flavor generating segment 1 as illustrated in FIG. 9.

EXAMPLES

Example 1

Eight layers of a tobacco sheet 10 with a thickness of 300 μm, a width of 7 mm, and a length of 12 mm are prepared. A rolling paper with a width of 14 mm and a length of 95 mm is prepared as a substrate 6, and the tobacco sheets 10 are stacked on the rolling paper parallel to the substrate, thereby forming a first tobacco member 1*a*. Three layers of tobacco sheets 10 are prepared in the same manner, and a second tobacco member 1*b* is formed on the rolling paper. Here, the end faces of the first tobacco member 1*a* and the second tobacco member 1*b* close to each other are separated by 71 mm. Hereinafter, the length parallel to the width direction of the substrate 6 is referred to as the "width" and the length parallel to the longitudinal direction of the substrate 6 is referred to as the "length" in each member.

Next, an opening with a width of 4 mm and a length of 2 mm is formed in the central part of the separating portion, and a support member, a cooling element, and a filter member are placed between the opening and the second tobacco member 1*b*. Here, the size of the support member is a width of 7 mm, a length of 8 mm, and a thickness of 5 mm; the size of the cooling element is a width of 7 mm, a length of 18 mm, and a thickness of 5 mm; and the size of the filter member is a width of 7 mm, a length of 7 mm, and a thickness of 5 mm. Subsequently, the substrate is folded such that the upper surfaces of the first tobacco member 1*a* and the second tobacco member 1*b* face each other, thereby manufacturing the flavor generating article 2 equipped with a rod tobacco segment 1.

A plate heater 30 with a thickness of 320 μm, a width of 4.9 mm, and a length of 13 mm is prepared and inserted into a space 14 formed between the first tobacco member 1*a* and the second tobacco member 1*b* of the tobacco segment 1. The heater 30 is then connected to a heating unit 32 equipped with a power supply and electrically heats the tobacco segment 1.

REFERENCE SIGNS LIST

1 Flavor generating segment
1*a* First flavor generating member
1*b* Second flavor generating member
10 Flavor generating sheet
14 Space
16 Heat transfer sheet
18 Separating portion
100 Stacked structure
G Distance between flavor generating sheets
T Thickness of flavor generating sheet
V Void
C Contact portion
2 Flavor generating article
20 Mouthpiece
22 Filter
24 Cavity
26 Support member
3 Flavor inhalation system
30 Heater
32 Heating unit
6 Substrate
60 Opening
62 Margin
64 Heater insertion opening
66 Bent portion

The invention claimed is:

1. A flavor generating segment comprising a first flavor generating member and a second flavor generating member, wherein:

the segment has a space between the first flavor generating member and the second flavor generating member;

at least either of the first and the second flavor generating members includes a plurality of stacked flavor generating sheets and, between at least a pair of the neighboring flavor generating sheets, a non-contact part in which the flavor generating sheets do not come into contact with each other is included;

principal surfaces of the flavor generating sheets face the other flavor generating member; and the face of the first flavor generating member, which face is exposed to the space and the face of the second flavor generating member, which face is exposed to the space are parallel to the longitudinal direction of the flavor generating segment.

2. The flavor generating segment according to claim 1, wherein between at least a pair of the neighboring flavor generating sheets, one or more contact portions in which the flavor generating sheets come into contact with each other are further included.

3. The flavor generating segment according to claim 2, wherein two or more of the contact portions are included, and the non-contact part is formed between the contact portions.

4. The flavor generating segment according to claim 1, wherein:

the first flavor generating member and the second flavor generating member each include a heat transfer sheet; and the heat transfer sheet is exposed to the space.

5. The flavor generating segment according to claim 1, wherein at least one of a plurality of the flavor generating sheets has underwent surface processing on at least either surface partially or completely.

6. The flavor generating segment according to claim 5, wherein the surface processing is crimping.

7. The flavor generating segment according to claim 1, further comprising a wrapper outside the flavor generating members.

8. A flavor generating article comprising the flavor generating segment according to claim 1 and a filter, wherein the article allows inhalation from a side of the filter.

9. A flavor inhalation system comprising the flavor generating segment according to claim 1 and a heater for heating the flavor generating segment.

10. The flavor inhalation system according to claim 9, wherein: the flavor generating segment has a space between the first flavor generating member and the second flavor generating member; and the heater has a shape that allows at least part of the heater to be positioned within the space.

11. The flavor inhalation system according to claim 10, wherein: the first flavor generating member and the second flavor generating member each include a heat transfer sheet exposed to the space; and the heat transfer sheet faces the heater.

12. The flavor inhalation system according to claim 9, wherein the heater is a plate heater.

13. A manufacturing method for the flavor generating segment according to claim 1, comprising:

a step A of placing the first flavor generating member and the second flavor generating member apart from each other on a substrate; and a step B of folding the substrate such that upper surfaces of the two flavor generating members face each other, thereby forming a rod segment.

14. The manufacturing method according to claim 13, wherein the step B further includes forming a space between the two flavor generating members facing each other.

15. The manufacturing method according to claim 13, wherein the step A further includes forming an opening on the substrate between the first flavor generating member and the second flavor generating member.

16. A precursor for the flavor generating segment according to claim 1, comprising:

a substrate; and a first flavor generating member and a second flavor generating member arranged apart from each other on the substrate, wherein:

at least either of the flavor generating members includes a plurality of flavor generating sheets stacked parallel to the substrate and has, between at least a pair of the neighboring flavor generating sheets, a non-contact part in which the flavor generating sheets do not come into contact with each other.

* * * * *